United States Patent [19]

DeLuca et al.

[11] 4,177,617

[45] Dec. 11, 1979

[54] THERMAL BLOCK

[76] Inventors: Anthony DeLuca; Josephine DeLuca, both of 8900 W. Sample Rd. #107, Coral Springs, Fla. 33065

[21] Appl. No.: 849,105

[22] Filed: Nov. 7, 1977

Related U.S. Application Data

[63] Continuation-in-part of Ser. No. 801,093, May 27, 1977, abandoned.

[51] Int. Cl.[2] ..... E04B 2/28

[52] U.S. Cl. ..... 52/562; 52/565

[58] Field of Search ..... 52/562, 565, 564, 275

[56] References Cited

U.S. PATENT DOCUMENTS

| | | | |
|---|---|---|---|
| 783,452 | 2/1905 | Morenus | 52/565 |
| 2,029,082 | 1/1936 | Odam | 52/275 |
| 2,261,510 | 11/1941 | Atcheson | 52/564 |
| 2,341,757 | 2/1944 | Brenneman | 52/562 |
| 2,647,392 | 8/1953 | Wilson | 52/565 |
| 2,817,965 | 12/1957 | Angelini | 52/562 |

FOREIGN PATENT DOCUMENTS

| | | | |
|---|---|---|---|
| 125530 | 9/1947 | Australia | 52/562 |
| 1016403 | 11/1952 | France | 52/565 |
| 130848 | 10/1918 | United Kingdom | 52/565 |
| 545387 | 5/1942 | United Kingdom | 52/565 |

OTHER PUBLICATIONS

Brick & Clay Record, Sep., 1949, p. 28.

*Primary Examiner*—John E. Murtagh
*Attorney, Agent, or Firm*—Robert D. Farkas

[57] ABSTRACT

A building wall utilizes a pair of cementuous blocks having a thermally insulating space therein-between. The blocks are fastened together by tie rods whose ends are secured in the spaced apart blocks. The portion of the rods extending between opposed lateral surfaces of the blocks have a portion of the length thereof formed into a "V" shape for concentrating water condensation trapped in the space between the blocks permitting the condensation to fall freely downwardly in the space. The blocks may be fabricated in conventional modular sizes or may be precast into any desired size such as an entire wall. Devices are provided for centering and locking together sets of blocks utilizing a tongue in groove arrangement in opposed horizontal marginal edges of one or both blocks.

9 Claims, 16 Drawing Figures

THERMAL BLOCK

This is a continuation-in-part application of Ser. No. 801,093 filed on May 27, 1977 now abandoned.

BACKGROUND OF THE INVENTION

1. The Field of the Invention

This invention relates to building wall construction and more particularly to that class of building wall having dead air spaces located intermediate the innermost and outermost lateral surfaces thereof.

2. Description of the Prior Art

The prior art abounds with building wall constructions having dead air spaces located intermediate the lateral surfaces thereof. U.S. Pat. No. 2,958,982 issued on Nov. 8, 1960 to G. W. Baker teaches a building wall construction having "V" shaped brackets acting as spacers for pairs of blocks located in spaced apart parallel relationship and secured to the "V" shaped spacers. The Baker patent suffers the deficiency of requiring an on site assembly of the "V" shaped spacers and the blocks comprising the innermost and outermost elements of the wall. Such on site construction costs makes the use of the Baker construction expensive by virtue of the cost of the spacer and the labor cost required to assemble some to the blocks making up the wall.

U.S. Pat. No. 3,286,428 issued on Nov. 22, 1965 to C. Kay discloses an apparatus similar in use and construction to the apparatus taught by Baker excepting the manner in which the "V" shaped spacer is secured to the wall elements spaced apart thereby. The Kay apparatus is specifically designed to accommodate the assembly of wooden panels and building blocks in removable installations and suffers the same deficiency as does the teachings of Baker.

The present invention teaches the construction of a building wall, either in modular form or in large wall sections which include a dead air space intermediate a pair of blocks or larger surfaces. The dead air space does not have large thermally conducting elements utilized to tie together the block elements, thus minimizing the thermal coupling between the outermost block and the innermost block in a wall construction. In subtropical climates, moisture tends to be trapped in the dead air space condensing on the innermost lateral surface of the wall promoting odors and deterioration of the supporting structure utilized to support the wall. The present invention employs rod elements, similar to reinforcing rods or rod elements having a smooth external surface, thereby minimizing the thermal coupling between the wall surfaces, whilst providing a strong unitary structure of blocks and rods. The rods may be utilized to lift and transport the wall, either in modular sizes or in larger sizes. Each rod element, embedded in the blocks, is provided with a "V" shaped excursion located near the center of the dead air space. The "V" shaped excursion permits condensation, gathered on the interior surfaces of the blocks, and on the rods, to descend downwardly to the lowermost located apex of the "V" shaped excursion so as to permit water droplets to fall therefrom into the center of the air space rather than running along the surface of the walls and the tie rods in preferential locations causing moisture tracks and causing moisture build-up on such surfaces.

The assembled blocks are light, do not require on site constructions, may be pre-finished on the exterior surfaces, and may be readily assembled to one another by utilizing tongue in grooves built into horizontal marginal edges of the inner block or the outer block, or both blocks.

Blocks, being provided in assembled form, having tie rods disposed between adjacent blocks, present a heavy and bulky structure to move. Furthermore, such devices are difficult to manufacture, as by molding. An alternate of the embodiment of the present invention utilizes tie rods having the "V" shaped excursion disposed separately from the blocks. Thus, the blocks may be molded, having metal plates therewithin. This facilitates utilizing standard block making machinery. The tie rods are then installed to a pair of blocks equipped with the metallic plates so as to join them together, either on site or at the facility which molds the blocks. In this fashion, great flexibility is provided in molding and in handling, as well as facilitating carrying means, for manually carrying assembled blocks from place to place.

SUMMARY OF THE INVENTION

A primary object of the present invention is to provide a building wall which contains a dead air space with a minimum of transverse thermally coupling elements extending there across, which permits the blocks comprising the wall to operate independently at different temperature levels.

Another object of the present invention is to provide a wall construction which may be fabricated utilizing conventional casting techniques and inexpensive metallic elements in the fabrication thereof at manufacturing sites other than the site of erection.

Still another object of the present invention is to provide a building wall construction which permits water that tends to condense on the innermost surfaces of such a wall to run off at preferred locations.

Yet another object of the present invention is to provide a wall construction which is light in weight and which may be lifted easily utilizing built in tie rods concealed after erection.

A further object of the present invention is to provide a wall construction which is termite proof and structurally sound for use in locales prone to natural disasters such as earthquakes, tornados, hurricanes and the like.

A still further object of the present invention is to provide a wall construction for interior or exterior use whose enclosed air cavity provides soundproofing and fireproofing characteristics.

Another object of the present invention is to provide a wall construction whose components may be fabricated with conventional block making machinery.

A still further object of the present invention is to provide a wall construction having two components that may be assembled either on the building site or in the manufacturing locality building the block.

Still another object of the present invention is to provide a building wall construction having steel plates embedded therein, thus providing additional structural support above and beyond the cementuous material covering same.

These objects as well as other objects of the present invention, will become more readily apparent after reading the following description of the accompanying drawings.

BRIEF DESCRIPTION OF THE DRAWINGS

FIG. 2 is a perspective view of a wall construction for an outside corner of a wall utilizing a pair of right angle block elements and tie rods extending there-in between.

DESCRIPTION OF THE PREFERRED EMBODIMENT

Figure 1:
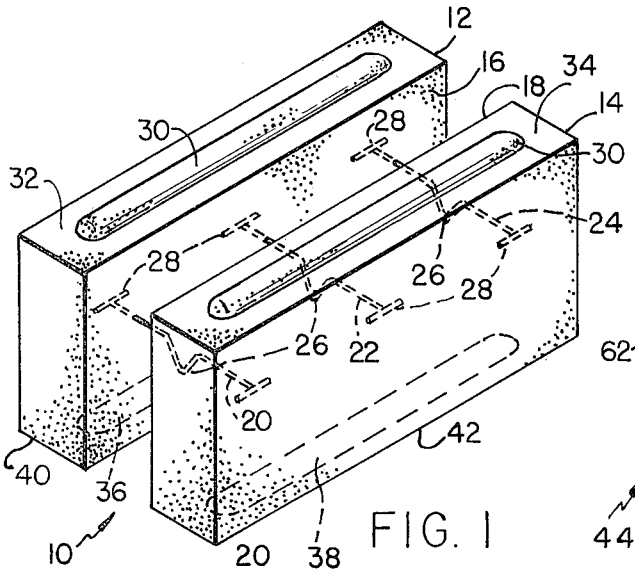
FIG. 1 is a perspective view of a modular building wall construction, having alignment tongues and notches therein, utilizing one embodiment of tie rods.

The structure and method of fabrication of the present invention is applicable to a pair of cast cementuous blocks having a generally rectangular bar shape, located in spaced apart parallel relationship and secured together by tie rods. The blocks have a generally rectangular bar shape which may be in modular sizes usually having the length and height thereof expressed in multiples of four inches. Thus for example, the length and height of each block may be 8"×16" or 12"×12" or 8"×12", as is commonly used in the construction of conventional cement or cinder blocks. The thickness of the blocks may be varied as a function of the strength requirements of the modular block assembly and may vary from 1" to 4", as desired. Alternatively, the present invention may be fabricated in unitary fashion so as to provide a larger unitary wall constructing apparatus whose height may be in the range of eight feet and whose length may be unlimited. The tie rods have their ends anchored into the blocks by being secured therein during the casting process. The materials comprising the block may be of any aggregate mixture. The preferred materials comprise two parts portland cement, three parts sand and two parts cinders or volcanic ash.

The tie rods are fabricated from steel or other metallic materials and may utilize ridges or other periodically spaced protrusions commonly seen in reinforcing rods, to secure the ends of the tie rods to the ends of the blocks during the casting process. The portion of the tie rods extending between the juxtaposed interior lateral surfaces of the block or wall assembly are provided with a "V" shaped excursion wherein the apex of the "V" extends downwardly. The apex is located substantially midway between the interior lateral surfaces of the block or wall assembly. The remaining portions of the exposed portion of the tie rod spanning the interior surfaces are coaxially aligned or alternatively may have the longitudinal axes thereof define an obtuse angle residing in the same plane as the "V" shaped excursion. The alternate embodiment tie rod enhances the tendency of water condensate to run downwardly along the portions of the exposed tie rod adjacent the "V" shaped excursion. Thus the water removal problem, most pronounced on the interior vertical surfaces of the wall assembly is improved as well as providing a longer path for the transmission of sound between the blocks. Thermal decoupling between the block elements is also enhanced thereby.

One or both uppermost marginal edges of the blocks in either the modular or larger unitary wall assembly sizes, may be provided with longitudinally outwardly extending bulbous protrusions, cast from the same materials and preferably at the same time as the materials forming the block. Such protrusions extend parallel to the interior juxtaposed lateral surfaces of the block assembly and are dimensioned to be received in complementary shaped grooves formed in the lowermost lateral marginal edges of the block assembly.

Corner block assemblies may be provided wherein the innermost inside corner block and the outermost corner block have legs in which the lateral surfaces of the individual blocks extend at right angles to one another. Such corner block assemblies may utilize one or more tie rods spanning the dead air space at a forty-five degree angle in a line located at the intersection of the legs forming the right angle corners thereof.

The ends of the tie rods, residing in the blocks may be more strongly anchored therein by having a pair of rods fixedly secured thereto such that the pair of rods extends normal to the plane defining the "V" shaped excursion and thus, horizontally in the block or wall assembly when in use. Alternatively, a pair of plates may be utilized in the place of pair of rods such that the plates reside in parallel spaced apart planes extending parallel to the interior lateral surfaces of the modular block or wall assembly. The pair of rods or the pair of plates provide additional resisting strength to outwardly or inwardly directed forces that may be applied to the block or wall assembly during use, erection or transporting. The pair of rods or plates may be assembled to the ends of the tie rods by welding. Alternatively, the ends of the tie rods may be bent into parallel relationship extending normally outwardly from the plane passing through the "V" shaped excursion.

An alternate embodiment of the present invention utilizes a plate disposed in each block forming a block assembly, wherein each block is disposed in side by side parallel relationship, disposed a fixed distance apart. Each of the blocks is provided having a "T" shaped slot disposed extending downwardly from the uppermost face thereof. The slot is preferably disposed extending only a portion of the height of the block, but may, if desired, extend along the entire height of each block. The free end of the leg portion of the "T" shaped slot are disposed facing each other for the two blocks making up the assembly. Each of said blocks are provided having a rectangular plate disposed therewithin and traversing the cross bars of the "T" shaped slots. Such plates may be provided having holes passing through the lateral surfaces thereof, such that the cementuous material comprising the block passes through the holes, anchoring the plate to the block. Such holes are located in positions in the plate intermediate adjacent "T" shaped slots. The lowermost region of the plate, disposed opposite the uppermost marginal edge of the block, is provided having a flange like anchoring plate fixedly secured thereto. The anchoring plate prevents the plate from moving upwardly and downwardly within the block when the plate is passed within the cemented material comprising the block.

The plate is provided having a plurality of elongated, spaced apart notches extending from the uppermost marginal edges thereof. Such notches are located aligned in the center of the "T" shaped slots intermediate the ends of the cross bars thereof. It is preferred that three such elongated slots and three such "T" shaped slots are provided for each block. One of the surfaces of the plates has a plurality of camming plates affixed thereto. Such camming plates are formed from a thin springy-like metallic material. Each camming plate is disposed adjacent an elongated slot in the plate having the lowermost marginal edges of the camming plate secured to the plate in a region adjacent the face of the elongated slot. A pair of slits are provided in each camming plate such that the central section is disposed moveable relative to the end sections which are secured, utilizing the rivets to the plate. The camming plate is formed so as to have an obtuse angle. One lateral surface of the camming plate, adjacent the end having the free end of the slits, is secured to the plate. The other end of the camming plate extends upwardly and outwardly therefrom, such that the other end of the camming plate is disposed outwardly from the uppermost marginal edge of the plate, such uppermost marginal edge having the entrance way for the elongated slot. Rivets may be utilized to secure the camming plate to the plate, if desired, however, other passing techniques, such as welding may also be utilized, if desired.

The tie rods are provided having a pair of spaced apart washer-like assemblies disposed adjacent each end thereof. Such washer assemblies may have square shapes. Opposed adjacent faces of adjacent washers are separated a distance slightly greater than the thickness of the plate embedded into each block. Thus, a tie rod may be inserted into an elongated slot, having each adjacent washer disposed on opposed faces of the plate. As the tie rod is pushed towards the bottom of the elongated slot, the center section of the camming plate comes into contact with a washer located at the end of the tie rod. The elongated slot extends further towards the lowermost portion of the plate than does the central section of the camming plate. When the rod is pushed further towards the face of the elongated slot, the outermost washer clears the lowermost marginal edge of the camming plate, causing the rod to be locked in position engaging the lowermost edge of the central region of the camming plate and the bottom of the elongated slot. An upper force exerted on the tie rod, in a direction towards the open mouth regions of the "T" shaped slots in the block, causes the outermost washer to engage the lowermost marginal edge of the central region of the camming plate, thereby enabling a user to lift the block by exerting the force on the tie rod in the direction towards the open-mouth region of the "T" shaped slot or the elongated slots in the plate. Conversely, applying the force towards the bottom of the block assembly causes the tie rod to come into contact with the bottom of the "T" shaped slots, thereby effectively locking in the tie rod to the block.

When a tie rod is simultaneously inserted into a pair of blocks, each having the leg portions facing one another, such blocks are tied together resisting forces applied to the blocks in any direction.

If desired, a plurality of tie rods may be tied together having the ends thereof disposed extending parallel to adjoining rods, joining a plurality of tie rods together, such joining rods may be secured anywhere along the length of the tie rods, in the region adjacent to or at the "V" shaped excursion in the centers thereof. Additionally, if desired, a wire-like handle, having an oblong opening therein, and having a downwardly extending leg, may be fastened to a single tie rod, such that the handle portion extends upwardly from the open mouth region of the "V" shaped protrusion. Obviously, such a handle may be attached to a plurality of tie rods wherein such plurality are joined together by adjoining rod. The same construction, utilizing the plate and camming plate and the tie rods having a pair of washers disposed at each end thereof, may be utilized with blocks having a "L" shaped like cross section, frequently used in corner constructions. If desired, a pair of plates, equipped with camming plates, may be disposed within one block, such that the block is provided having a pair of "T" shaped slots, having their crossbars shaped disposed in adjacent to one another and having their legs extending in opposite directions. Such a block may be utilized intermediate a pair of blocks, wherein such pair of blocks are provided having a "T" shaped slot disposed in only one lateral face thereof. The same tie rods may be utilized to join together three of such blocks into a three-tiered wall block, having an outermost block, an innermost block, and an intermediate block. Obviously, if desired, more than three blocks may be utilized so as to form a wall construction having as many blocks as required.

Because of the structural nature of the plate apparatus adding strength to the cementuous material comprising the building block, such cementuous material may be fabricated from materials whose strength need not be as great as unsupported blocks. Additionally, the choice of proper materials, tending to minimize weight, can also be utilized so as to enhance the thermal insulating capabilities of the block. We have discovered that a good composite block may be fabricated from conventional cementuous materials having as much as 25% of the total volume making up such materials, utilizing a pumice material therefor. Though pumice does not represent the material possessing high compressive strength, it does provide an excellent form of thermal insulation. The weight of the plate, preferably fabricated from steel, and the weight of the camming plate, also preferably fabricated from steel, may be more than compensated for by utilizing pumice in the advocate making up the cementuous material of the block.

Now referring to the figures, and more particularly to FIG. 1 showing a modular building wall assembly 10 utilizing block 12 and block 14. Interior lateral surfaces 16 and 18 are spaced apart in parallel relationship having tie rods 20, 22 and 24 spanning there across. Each of the tie rods are provided with a "V" shaped excursion 26 whose apex extends in a downward direction. The free ends of the tie rods terminate in additional lengths of rods 28 whose longitudinal axis extends parallel to lateral surfaces 16 and 18 and normal to the plane containing excursion 26. Such modular wall assemblies may be provided with protrusions 30 located along the uppermost marginal edges 32 and 34 of blocks 12 and 14 respectively. Complementary grooves 36 and 38 reside in the lowermost horizontal marginal edges 40 and 42 of blocks 12 and 14 respectively.

Figure 2:
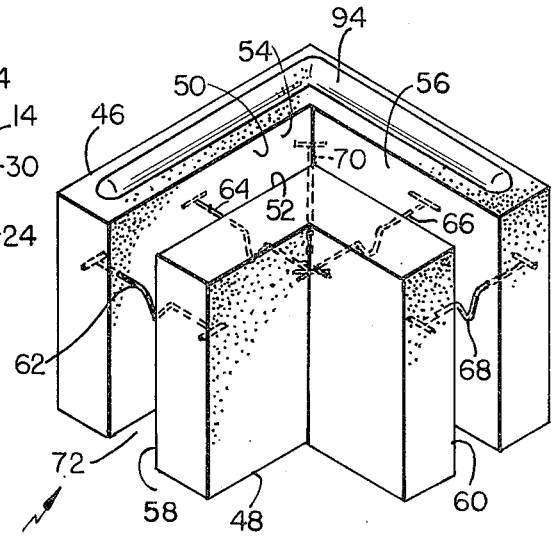

FIG. 2 illustrates a corner modular block assembly 44 fabricated from right angle blocks 46 and 48 having juxtaposed interior lateral surfaces 50 and 52. The lateral surfaces 50 and 52 are formed into legs 54 and 56 and 58 and 60 respectively. Tie rods 62 and 64 extend between lateral surfaces 52 and 54. Tie rods 66 and 68 extend between interior lateral surfaces 56 and 60. Tie rod 70 extends between block 46 and 48 intermediate legs 54 and 56 across the dead air space 72 to the juncture of surfaces 52 and 60. Uppermost marginal edge 94 is provided with a bulbous protrusion 96 extending at right angles for use in insertion in a complementary shaped groove in an adjacent upperblock, not shown. The uppermost marginal edge 98, of block 48, is shown without a protrusion. A protrusion, not shown, similar to protrusion 96 may be provided on surface 98 if desired. The surface 98 may be maintained without such a protrusion when providing support for ceiling beams or floor joints as desired.

Figure 3:
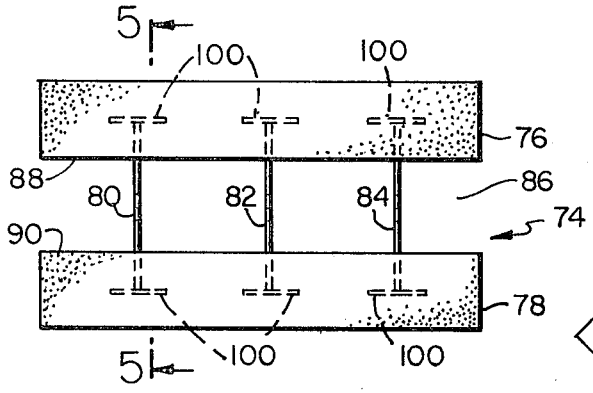
FIG. 3 is a plan view of a building wall construction including a plurality of tie rods, of non-modular form.

FIG. 3 shows a unitary wall assembly 74 fabricated from blocks 76 and 78, having tie rods 80, 82 and 84 spanning dead air space 86. Interior lateral surfaces 88 and 90 are shown in parallel spaced apart relationship. It should be noted that the uppermost marginal edges 90 and 92 do not contain bulbous protrusions such as are illustrated as numeral 30 in FIG. 1. Plates 100 are secured to the ends of tie rods 80, 82 and 84, having a square or rectangular bar shape and lateral surfaces extending parallel to surfaces 88 and 90. Plates 100 may supplant plates 100.

Figure 4:
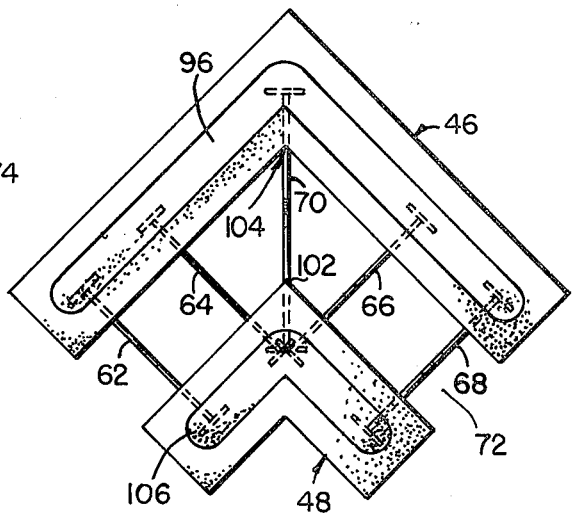
FIG. 4 is a plan view of the apparatus illustrated in FIG. 2, wherein the inside corner block is additionally provided with a tongue element.

FIG. 4 illustrates tie rods 62, 64, 66 and 68 spanning air space 44 separating blocks 46 and 48. Tie rod 70 is shown spanning air space 44 at the outside corner 102 of block 48, and the inside corner 104 of block 46. The uppermost marginal edge 98 is shown provided with protrusion 106.

Figure 5:
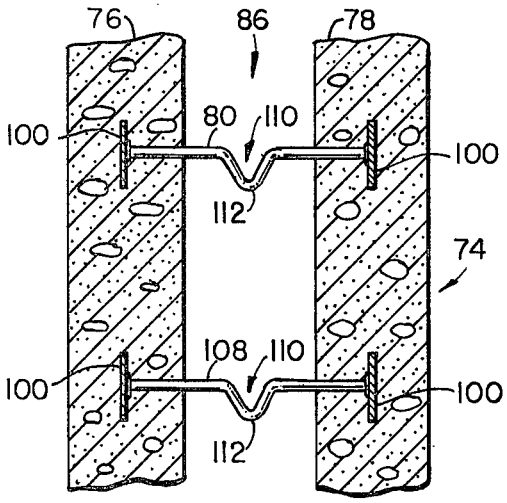
FIG. 5 is a cross-sectional side elevation view taken through lines 5—5 viewed in the direction of arrows 5—5 of the apparatus shown in FIG. 3.

FIG. 5 illustrates block 76 and block 78. Plates 100 are shown attached at the ends of tie rods 80 and 108. Tie rod 108 is shown located below tie rod 80. "V" shaped excursions 110 are adapted with apexes 112 pointing in a downward direction.

Figure 6:
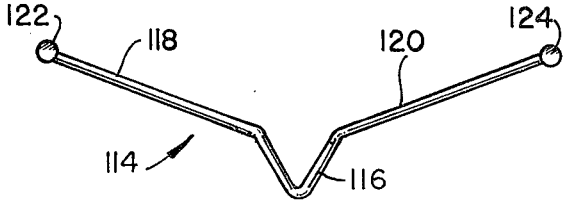
FIG. 6 is a side-elevational view of an alternate embodiment of the tie-rod apparatus shown in FIGS. 1, 2 and 5.

FIG. 6 illustrates an alternate embodiment of a tie rod 114 having a "V" shaped excursion 116 and longitudinally extending legs 118 and 120. Legs 118 and 120 have the longitudinal axes thereof disposed forming an obtuse angle and terminate in rods 122 and 124. Rods 122 and 124 are destined to be anchored in blocks 12 and 14, as shown in FIG. 1, or tie rods 80, 82 and 84 as shown in FIG. 3 when tie rod 114 supplants tie rod 26 shown in FIG. 1 or tie rods 80, 82 and 84 as shown in FIG. 3. Plates 100 as shown in FIG. 5, may be utilized instead of rods 122 and 124, if desired.

Figure 7:
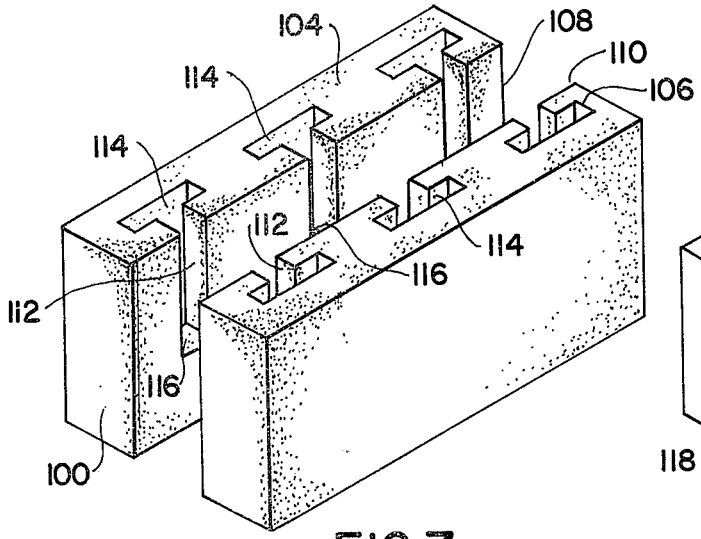
FIG. 7 is a perspective view of still another alternate embodiment of the present invention.

FIG. 7 illustrates an alternate embodiment of the present invention utilizing block 100 and block 102 disposed having uppermost marginal edges 104 and 106 respectively. Opposed adjacent faces 108 and 110 are shown provided having the leg-like openings 112 of "T" shaped slots 114 disposed facing each other. Tie rods 116 are shown passing through leg-like openings 112.

Figure 8:
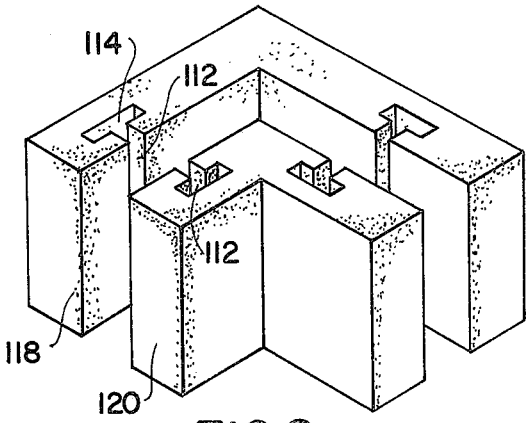
FIG. 8 is a perspective view of the corner block assembly of the alternate embodiment of the present invention.

FIG. 8 illustrates blocks 118 and 120, each having an "L" shaped cross-section and each having "T" shaped slots 114 therein disposed having leg-like openings 112 facing one another.

Figure 9:
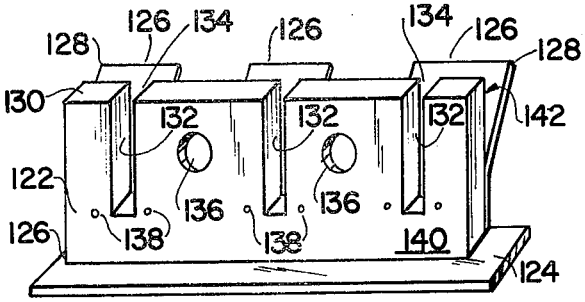
FIG. 9 is a perspective view of the metallic plate insert of the alternate embodiment.

FIG. 9 illustrates plate 122 shown having anchoring plates 124 secured to the lowermost marginal edge 126 thereof. It should be noted that anchoring plate 124 extends outwardly from the marginal edges defining plate 122. Camming plates 126 are shown extending outwardly at ends 128 thereof from the uppermost marginal edge 130, of plate 122. Elongated slots 132 are shown residing in plate 122 having open mouth portions 134 located in uppermost marginal edge 130. Anchoring holes 136 are shown located between adjacent elongated slots 132. Rivets 138 are shown passing through lateral surface 140, of plate 122, and are utilized to secure camming plates 126 to surface 142, of plate 122.

Figure 10:
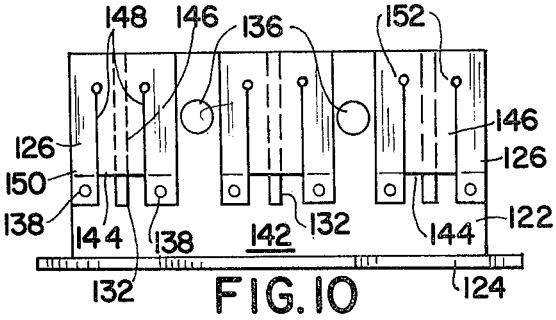
FIG. 10 is a rear elevation view of the embodiment illustrated in FIG. 9.

FIG. 10 illustrates plate 122 having camming plates 126 secured to surface 142 thereof. Elongated slots 132 are shown extending below lowermost marginal edge 144 of central region 146, of camming plate 126. Central region 146 is defined by slits 148 extending along the length of camming plates 126 and upwardly from marginal edge 148 thereof. Rivets 138 are shown secured only to outermost pair of portions 150 of camming plate 126. Thus, central region 146 may move outwardly from surface 142, particularly in the area defined by lowermost marginal edge 144 thereof. Circular cut-outs 152 are shown at the uppermost ends of slits 148, facilitating the region 146 from moving independently from the balance of camming plates 126 particularly lowermost marginal edge 144 thereof.

Figure 11:
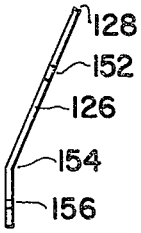
FIG. 11 is a side elevation view of the camming plate shown in FIGS. 9 and 10.

FIG. 11 illustrates camming plates 126 shown having a bend in the region of numeral 154. Holes 156 are utilized for passing rivets 138, shown in FIG. 9 therethrough. Hole 152 is shown intermediate uppermost edge 128 and bend region 154.

Figure 12:
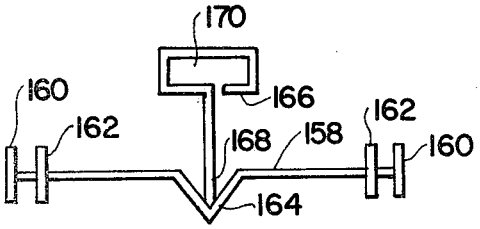
FIG. 12 is a front elevation view of a tie rod assembly useful with the embodiment illustrated in FIGS. 7 and 8.

FIG. 12 illustrates tie rod 158 shown having outermost washer-like elements 160 and adjacent washer elements 162. Washer elements 160 are shown secured to the ends of tie rod 158, whilst washer elements are spaced apart therefrom a distance roughly equivalent to the thickness of plate 122, shown in FIG. 9. "V" shaped excursion 164 is shown extending intermediate washer elements 162. If desired, wire-like handle elements 166 may have end 168 thereof, secured to tie rod 168. Handholding opening 170 is shown provided. End 168 may be located anywhere along the length of tie rod 158.

Figure 13:
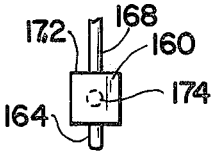
FIG. 13 is a side elevation view of the apparatus shown in FIG. 12.

FIG. 13 illustrates an end view of the apparatus shown in FIG. 12 illustrating washer-like element 160, shown having uppermost marginal edge 172 thereof, forming parts of the square like shape. Dotted lines 174 illustrate the cross-sectional shape of tie rod 158 adjacent washer-like element 160. Protrusion of "V" shaped excursion 164 is shown extending downwardly from washer-like element 160.

Figure 14:
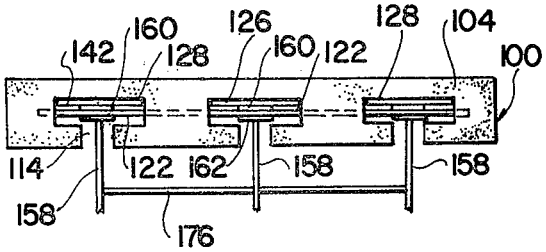
FIG. 14 is a plan view of a portion of the apparatus shown in FIG. 7.

FIG. 14 illustrates a top view of block 100, wherein surface 104 is shown having "T" shaped slots 114 therein. Tie rods 158 are shown extending outwardly from the leg portions of the "T" shaped slots and are coupled together, if desired, by a joining rod 176, such joining rod may be secured to the tie rods 158, at any location along the length thereof, including "V" shaped excursion 164, shown in FIG. 12. Washer-like elements 162 are shown disposed on one side of plate 122 whilst washer-like elements 160 are shown disposed on the other side of plate 122. Camming plates 126 may be seen disposed having uppermost marginal edges 128 located outwardly from washer-like elements 160 and surface 142 of plate 122.

Figure 15:
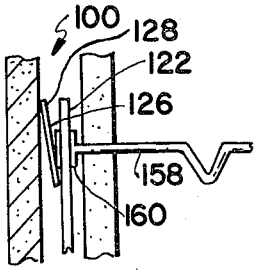
FIG. 15 is a side elevation cross-sectional view of a portion of the apparatus shown in FIG. 14.

FIG. 15 illustrates block 100 having plate 122 disposed therewithin. Tie rod 158 is shown in an unseated position such that washer-like element 160 is disposed in touching enegagement with camming plates 126 at a location below uppermost marginal edge 128 thereof.

Figure 16:
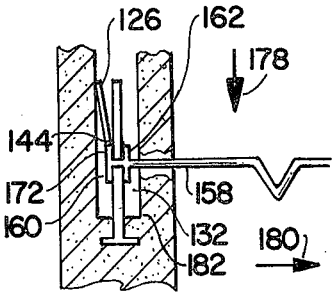
FIG. 16 is a side elevation view of the apparatus shown in FIG. 15, having the tie rod disposed in a downward position.

FIG. 16 illustrates the same apparatus shown in FIG. 15 excepting that a force has been applied to tie rod 158 in the direction of arrow 178. Camming plate 126 is shown having marginal edge 144 thereof engaging in uppermost region 172 of washer element 160, thereby preventing tie rod 158 from moving in the direction opposite to arrow 178. Marginal edge 144, of camming plate 126, is urged in the direction of arrow 180, due to the inherent spring-like characteristics of the camming plate exerted by outermost regions 150 thereof, shown in FIG. 10. Washer-like element 162, combined with element 160, prevent the motion of tie rod 158, in the direction of arrow 180, or in the direction opposite thereto. Line 182 represents the bottom of the "T" shaped slots 114, shown in FIG. 7, thereby preventing tie rod 158, from moving downwardly in the direction of arrow 178, from the position shown.

One of the advantages of the present invention is a building wall which contains a dead air space with a minimum of transverse thermally coupling elements extending there across, which permits the blocks comprising the wall to operate independently at different temperature levels.

Another advantage of the present invention is a wall construction which may be fabricated utilizing conventional casting techniques and inexpensive metallic elements in the fabrication thereof at manufacturing sites other than the site of erection.

Still another advantage of the present invention is a building wall construction which permits water that tends to condense on the innermost surfaces of such a wall to run off at preferred locations.

Yet another advantage of the present invention is a wall construction which is light in weight and which may be lifted easily utilizing built in tie rods concealed after erection.

A further advantage of the present invention is a wall construction which is termite proof and structurally sound for use in locales prone to natural disasters such as earthquakes, tornados, hurricanes and the like.

A still further advantage of the present invention is a wall construction for interior or exterior use whose enclosed air cavity provides soundproofing and fireproofing characteristics.

Thus there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. A building wall comprising:

a block, said block having a lateral surface, a plate, said plate disposed secured within said block, said lateral surface having an opening therein communicating with said plate, at least one rod, a portion of the length of said at least one rod having means for causing water condensate to concentrate at a point along the length of said at least one rod, located outwardly from said lateral surface when said at least one rod is disposed secured to said plate, means to secure one end of said at least one rod to said plate having said one end of said at least one rod disposed passing through said opening in said lateral surface, a pair of washer like elements, said pair of washer like elements being disposed at said one end of said at least one rod, another pair of washers, said another pair of washers disposed at the other end of said at least one rod, said pair of washers and said another pair of washers disposed in spaced-apart relationship secured to said at least one rod and extending radially outwardly therefrom.

2. The apparatus as claimed in claim 1 wherein said water concentrating means comprises a portion of said portion of said at least one rod being formed into a "V" shape, the remaining portions of said portion having a common longitudinal axis, said longitudinal axis of said remaining portions disposed extending normal to said lateral surface when said one end of said at least one rod is disposed fixedly secured to said plate.

3. The apparatus as claimed in claim 1 further comprising another block, said another block having another plate disposed secured therewithin, said another block having another opening communicating with said another plate passing through a lateral surface of said another block, means to secure the other end of said at least one rod to said another plate having said lateral surface and said lateral surface of said another block disposed in spaced-apart relationship and having said means for causing water condensate disposed intermediate said lateral surface and said another lateral surface.

4. The apparatus as claimed in claim 1 wherein said plate has at least one elongated slot disposed communicating with a marginal edge thereof, a camming plate, said camming plate fixedly secured to said plate, one marginal edge of said camming plae disposed extending outwardly from said marginal edge of said plate, another marginal edge of said camming plate disposed adjacent the end of said slot.

5. The apparatus as claimed in claim 1 further comprising a handle-like element, said handle-like element having one end thereof fixedly secured to said at least one rod.

6. The apparatus as claimed in claim 1 further comprising another rod, said another rod being identical to said at least one rod, means to secure said another rod and said at least one rod together.

7. The apparatus as claimed in claim 1, wherein said block comprises a cementuous material, said cementious material including pumice.

8. The apparatus as claimed in claim 1 further comprising said plate having at least one opening therein.

9. The apparatus as claimed in claim 1 wherein said opening in said block has a "T"-like shape, said one end of said rod being disposed passing through a leg portion of said "T"-like shape.

* * * * *